US011649824B2

(12) United States Patent
Huang

(10) Patent No.: US 11,649,824 B2
(45) Date of Patent: May 16, 2023

(54) LIQUID-COOLING PUMP AND FLOW CHANNEL STRUCTURE THEREOF

(71) Applicant: Huizhou Hanxu Hardware Plastic Technology Co., Ltd., Guangdong (CN)

(72) Inventor: Tsung-Hsien Huang, Guangdong (CN)

(73) Assignee: HUIZHOU HANXU HARDWARE PLASTIC TECHNOLOGY CO., LTD., Guangdong (CN)

( * ) Notice: Subject to any disclaimer, the term of this patent is extended or adjusted under 35 U.S.C. 154(b) by 91 days.

(21) Appl. No.: 17/412,275

(22) Filed: Aug. 26, 2021

(65) Prior Publication Data

US 2022/0381263 A1 Dec. 1, 2022

(30) Foreign Application Priority Data

May 28, 2021 (CN) ..... 202110593266.1

(51) Int. Cl.
*F04D 29/42* (2006.01)
*F04D 1/00* (2006.01)

(52) U.S. Cl.
CPC ..... *F04D 1/00* (2013.01); *F04D 29/426* (2013.01); *F05D 2210/11* (2013.01); *F05D 2240/12* (2013.01)

(58) Field of Classification Search
CPC ..... F04D 29/426; F04D 1/00
See application file for complete search history.

(56) References Cited

U.S. PATENT DOCUMENTS 5,074,764 A * 12/1991 Kobayashi ..... F04D 13/086 417/423.9
5,154,573 A * 10/1992 Buse ..... F04D 29/0462 415/110
2005/0244292 A1* 11/2005 Tomioka ..... F04D 29/426 417/423.3

* cited by examiner

*Primary Examiner* — Michael L Sehn
(74) *Attorney, Agent, or Firm* — Leong C. Lei

(57) ABSTRACT

A liquid-cooling pump and a flow channel structure thereof are disclosed. The flow channel structure includes a liquid pump mounting chamber. A bottom of the liquid pump mounting chamber is centrally formed with a liquid inlet. A peripheral side of the liquid pump mounting chamber is formed with a liquid outlet. An inner wall of the peripheral side of the liquid pump mounting chamber is convexly provided with a protruding boss corresponding to one side of the liquid outlet and surrounding an impeller, and is concavely provided with a guide groove corresponding to another side of the liquid outlet and surrounding the impeller. The protruding boss is gradually thinned along a rotating direction of the impeller. The guide groove is gradually deepened along the rotating direction of the impeller and communicates with the liquid outlet.

8 Claims, 8 Drawing Sheets

LIQUID-COOLING PUMP AND FLOW CHANNEL STRUCTURE THEREOF

BACKGROUND OF THE INVENTION

1. Field of the Invention

The present invention relates to a liquid pump, and more particularly to a liquid-cooling pump and a flow channel structure thereof. The liquid-cooling pump is mainly applied to a liquid-cooling radiator, but not limited thereto.

2. Description of the Prior Art

In general, a liquid-cooling radiator assembly is composed of a liquid-cooling radiator and a liquid-cooling block. A liquid pump is configured to circulate the liquid in the liquid-cooling radiator and the liquid-cooling block. After the liquid absorbs the heat from the liquid-cooling block, it flows into the liquid-cooling radiator to dissipate heat, and then the liquid after heat dissipation flows back into the liquid-cooling block. The performance of the liquid pump directly affects the flow smoothness and flow rate of the liquid. In actual use, it is necessary to increase the rotational speed of an impeller and the size of the entire liquid pump, etc. for selecting a liquid pump with larger working performance parameters to increase the flow rate. On the one hand, the cost is high, and the energy consumption is large. On the other hand, its application is limited because it is large in size. Therefore, for those with high requirements for size or/and power consumption, the flow smoothness and flow rate of the liquid in the conventional liquid pump are limited, and it is difficult to meet higher requirements for performance.

Accordingly, the inventor of the present invention has devoted himself based on his many years of practical experiences to solve these problems.

SUMMARY OF THE INVENTION

In view of the defects of the prior art, the primary object of the present invention is to provide a liquid-cooling pump and a flow channel structure thereof. The flow channel structure plays a good role of guiding water, and has better smoothness, and is conducive to improving the working efficiency of the liquid pump.

In order to achieve the above objects, the present invention adopts the following technical solutions:

A flow channel structure of a liquid-cooling pump comprises a liquid pump mounting chamber. A bottom of the liquid pump mounting chamber is centrally formed with a liquid inlet. A peripheral side of the liquid pump mounting chamber is formed with a liquid outlet. An inner wall of the peripheral side of the liquid pump mounting chamber is convexly provided with a protruding boss corresponding to one side of the liquid outlet and surrounding an impeller, and is concavely provided with a guide groove corresponding to another side of the liquid outlet and surrounding the impeller. The protruding boss is gradually thinned along a rotating direction of the impeller. The guide groove is gradually deepened along the rotating direction of the impeller. A distal end of the guide groove communicates with the liquid outlet.

Preferably, a starting end of the protruding boss is a concave arcuate surface. When a liquid flushes to the starting end of the protruding boss, the concave arcuate surface provides a partial stop function for the liquid to flow back to the liquid outlet.

Preferably, the guide groove is gradually widened along the rotating direction of the impeller.

Preferably, the guide groove has an arc-shaped, V-shaped or rectangular cross-section.

Preferably, an annular wall is provided around an outer periphery of the liquid inlet to form a pressurizing chamber.

Preferably, a starting end of the guide groove is spaced a determined distance apart from a distal end of the protruding boss.

Preferably, the protruding boss and the guide groove are perpendicular to the inner wall of the peripheral side of the liquid pump mounting chamber.

A liquid-cooling pump comprises the foregoing liquid pump mounting chamber and an impeller mounted in the liquid pump mounting chamber. When the impeller rotates, a liquid is driven to flow along the protruding boss and the guide groove to the distal end of the guide groove to enter the liquid outlet, and the liquid is discharged from the liquid outlet.

Compared with the prior art, the present invention has obvious advantages and beneficial effects. Specifically, it can be known from the above technical solutions. The inner wall of the peripheral side of the liquid pump mounting chamber is convexly provided with the protruding boss corresponding to one side of the liquid outlet and surrounding the impeller, and is concavely provided with the guide groove corresponding to the other side of the liquid outlet and surrounding the impeller. The flow channel structure plays a good role of guiding water, has better smoothness, is conducive to the increase of flow rate, and is conducive to improving the working efficiency of the liquid pump. Besides, the starting end of the protruding boss is a concave arcuate surface. When the liquid flushes to the starting end of the protruding boss, the concave arcuate surface provides a partial stop function for the liquid to flow back to the liquid outlet, so as to ensure the liquid output of the liquid outlet.

Embodiments of the present invention will now be described, by way of example only, with reference to the accompanying drawings.

DETAILED DESCRIPTION OF THE PREFERRED EMBODIMENTS

Figure 1:
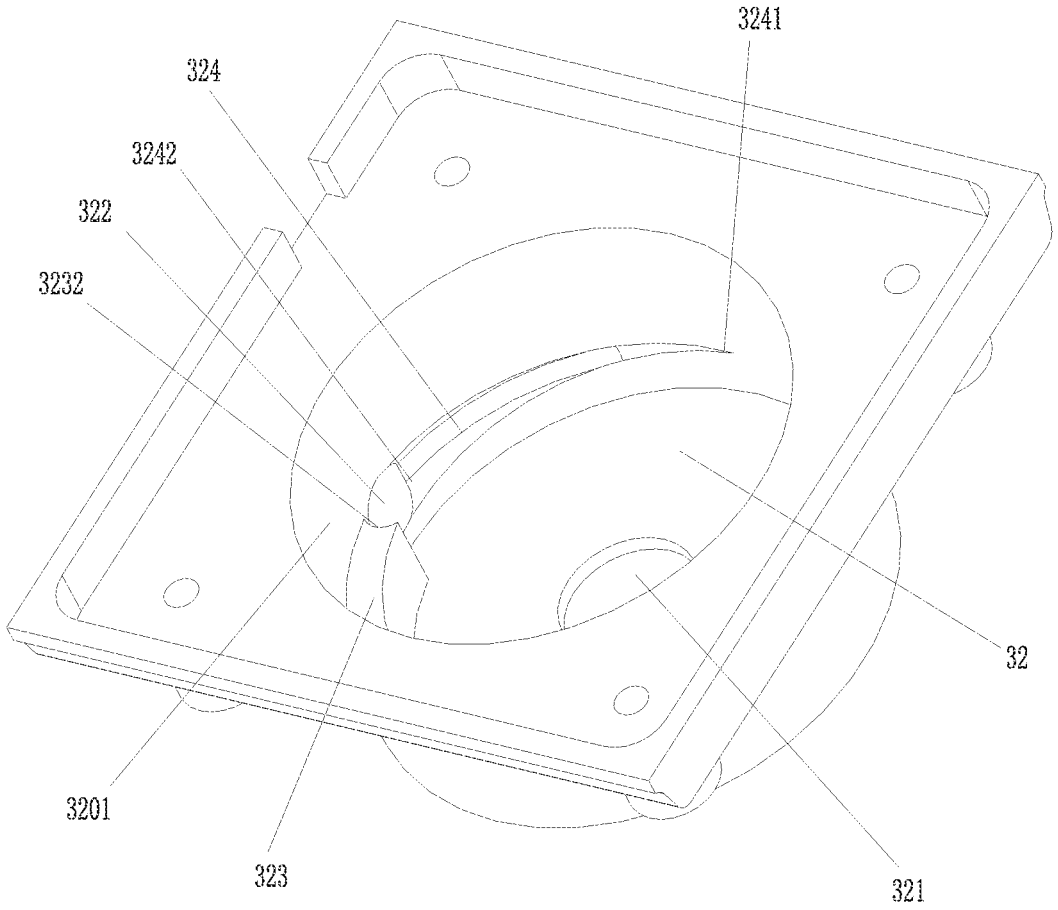
FIG. 1 is a perspective view of the liquid pump mounting chamber according to a first embodiment of the present invention.

FIGS. 1 to 8 show the specific structure of a preferred embodiment of the present invention.

A flow channel structure of a liquid-cooling pump comprises a liquid pump mounting chamber 32. The bottom of the liquid pump mounting chamber 32 is centrally formed with a liquid inlet 321. The peripheral side of the liquid pump mounting chamber 32 is formed with a liquid outlet 322. The inner wall 3201 of the peripheral side of the liquid pump mounting chamber 32 is convexly provided with a protruding boss 323 corresponding to one side of the liquid outlet 322 and surrounding an impeller 41, and is concavely provided with a guide groove 324 corresponding to the other side of the liquid outlet 322 and surrounding the impeller 41. Both the protruding boss 323 and the guide groove 324 are perpendicular to the inner wall 3201 of the peripheral side of the liquid pump mounting chamber 32. The protruding boss 323 is gradually thinned along the rotating direction of the impeller 41. The guide groove 324 is gradually deepened and widened along the rotating direction of the impeller 41. The distal end 3242 of the guide groove 324 communicates with the liquid outlet 322.

Figure 2:
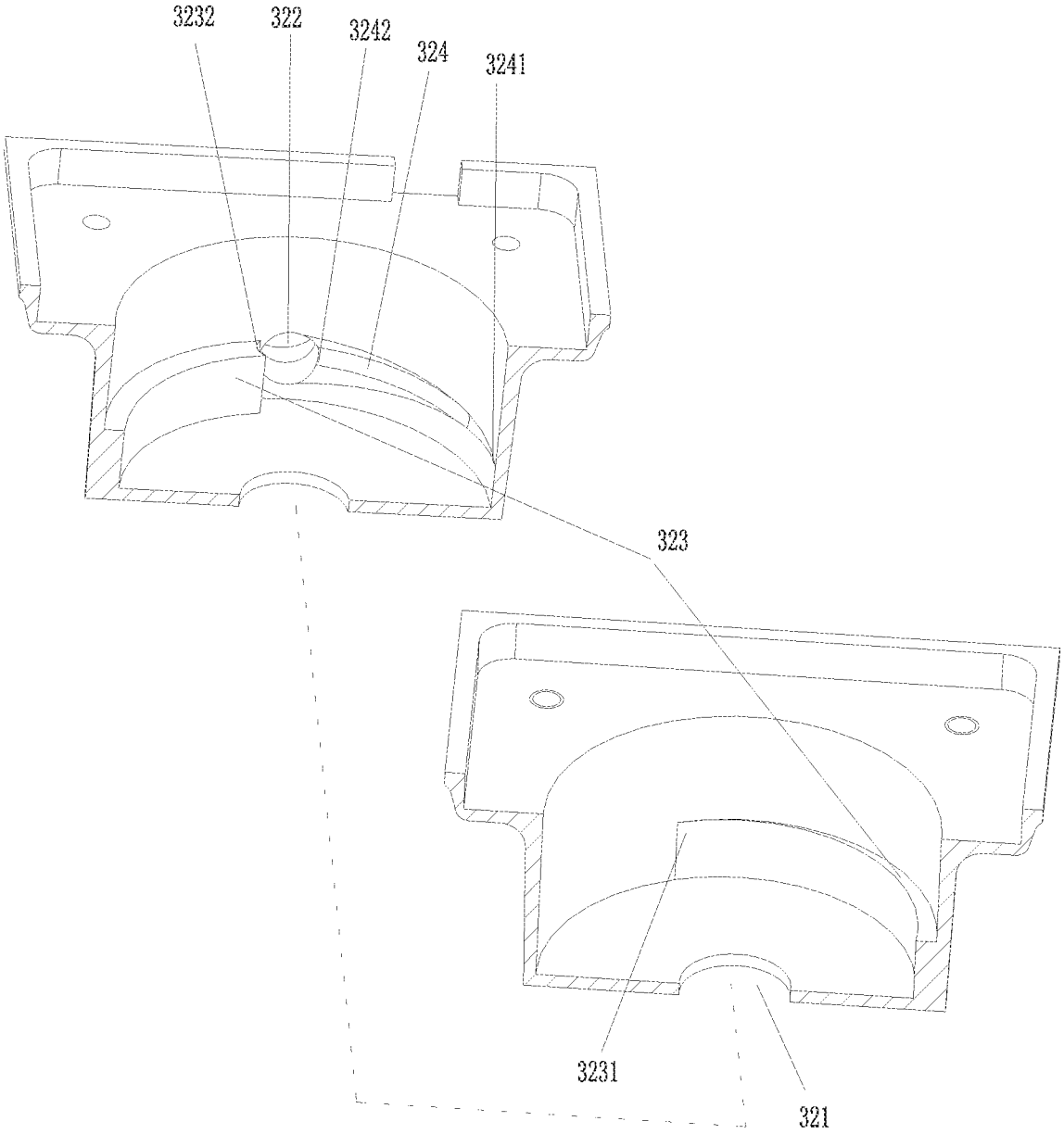
FIG. 2 is a cross-sectional view of the liquid pump mounting chamber according to the first embodiment of the present invention.
Figure 3:
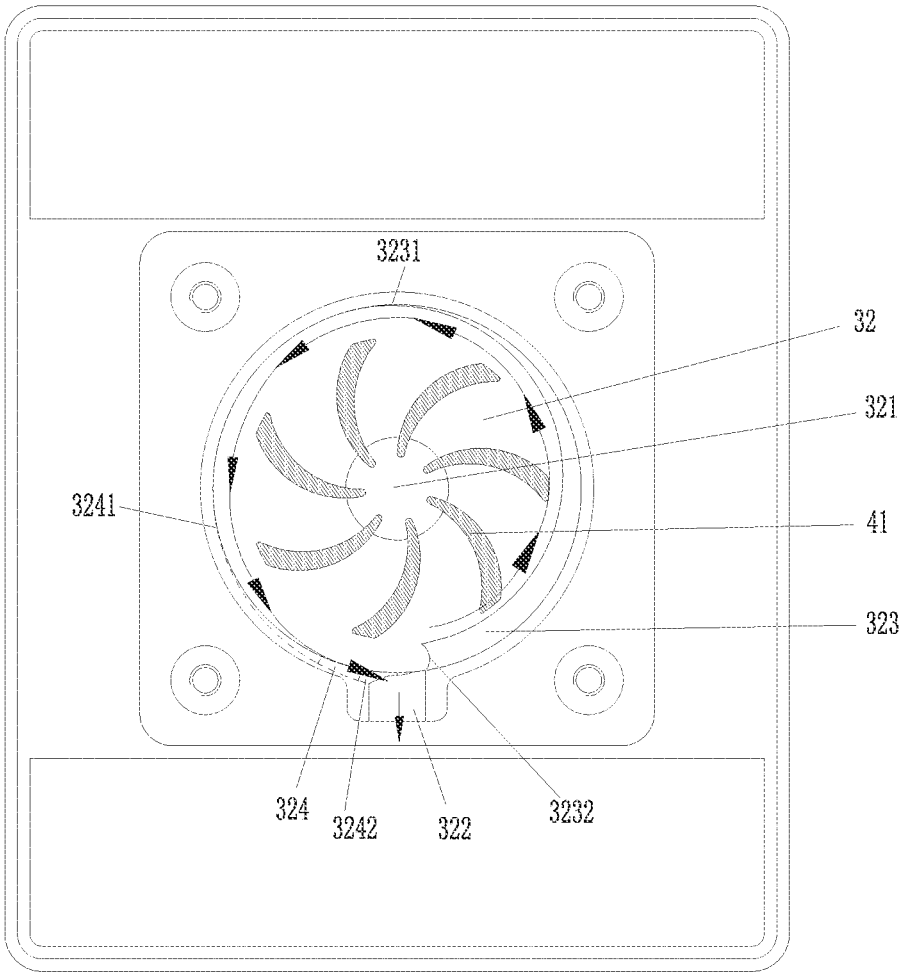
FIG. 3 is a schematic view showing the application of the liquid pump mounting chamber according to the first embodiment of the present invention.

As shown in FIGS. 1 to 3, the distal end 3231 of the protruding boss 323 extends to a position opposite to the liquid outlet 322. The starting end 3241 of the guide groove 324 is spaced a determined distance apart from the distal end 3231 of the protruding boss 323. The liquid is rotated along the protruding boss 323. The liquid-containing space is gradually enlarged until the maximum area between the distal end 3231 of the protruding boss 323 and the starting end 3241 of the guide groove 324. From the starting end 3241 of the guide groove 324, the liquid is rotated and guided to flow along the guide groove 324 to the liquid outlet 322. The guide groove 324 is gradually widened and deepened toward the liquid outlet 322, which is beneficial for the liquid to quickly pass through the guide groove 324 to the liquid outlet 322. Preferably, the starting end 3232 of the protruding boss 323 is a concave arcuate surface. When the liquid flushes to the starting end 3232 of the protruding boss 323, the concave arcuate surface provides a partial stop function for the liquid to flow back to the liquid outlet 322, so as to ensure the liquid output of the liquid outlet 322.

Figure 4:
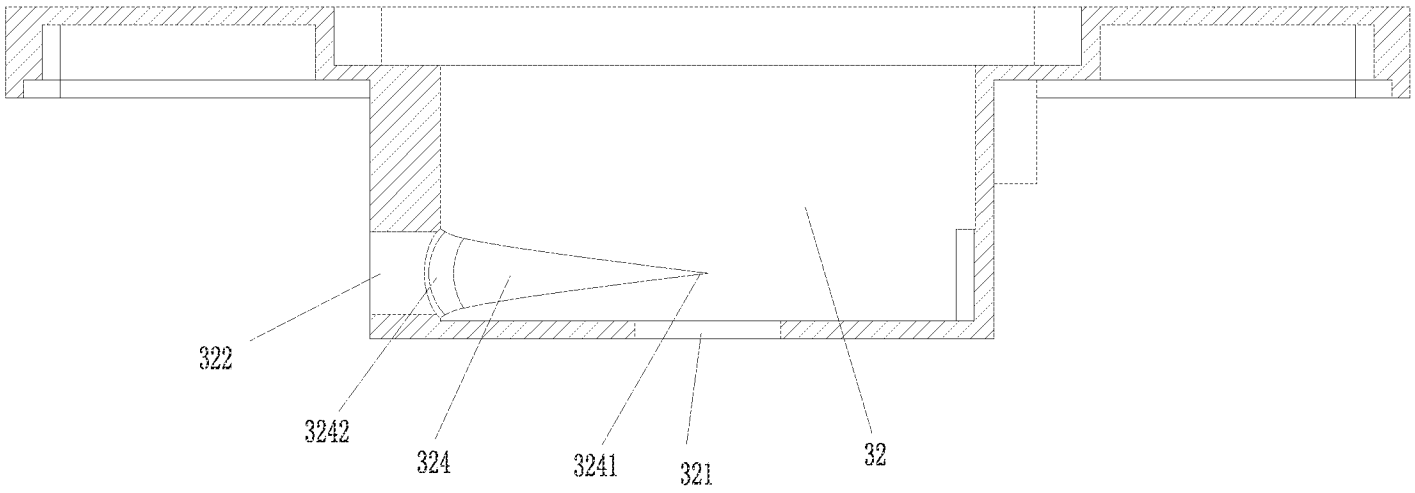
FIG. 4 is a cross-sectional view of the liquid pump mounting chamber according to the first embodiment of the present invention, wherein the guide groove is an arc-shaped groove.
Figure 5:
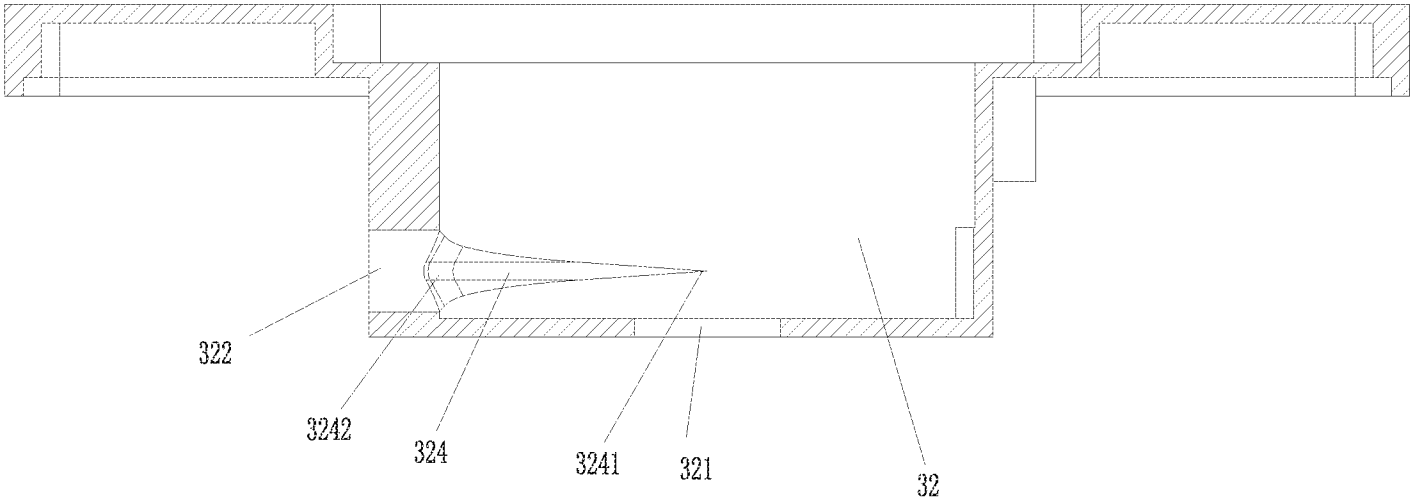
FIG. 5 is a cross-sectional view of the liquid pump mounting chamber according to the first embodiment of the present invention, wherein the guide groove is a V-shaped groove.
Figure 6:
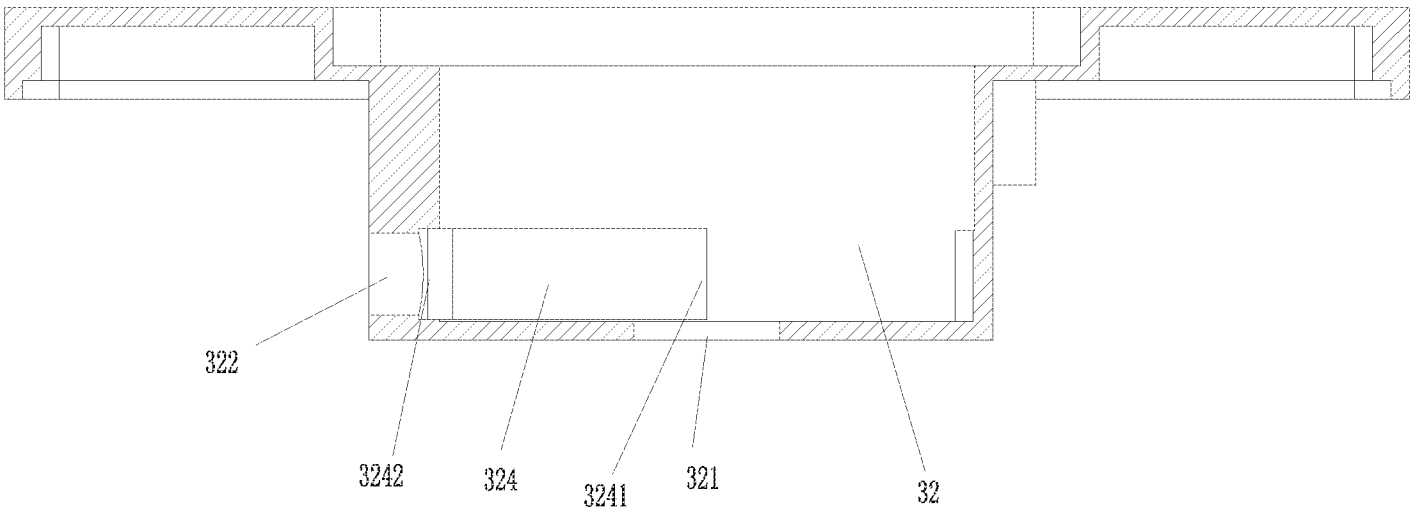
FIG. 6 is a cross-sectional view of the liquid pump mounting chamber according to the first embodiment of the present invention, wherein the guide groove is a rectangular groove.

As shown in FIGS. 4 to 6, the guide groove 324 may have an arc-shaped, V-shaped or rectangular cross-section.

Figure 7:
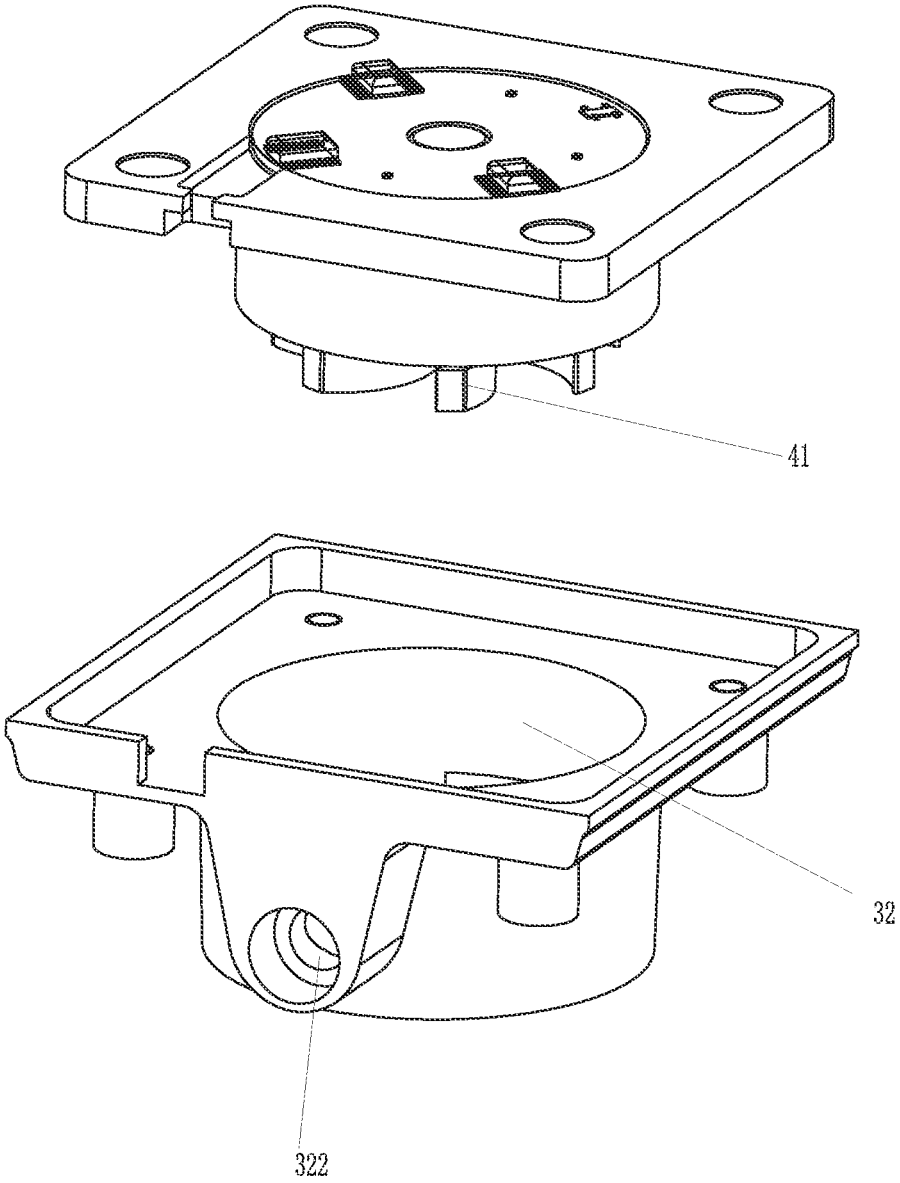
FIG. 7 is an exploded view of the liquid pump according to a second embodiment of the present invention.
Figure 8:
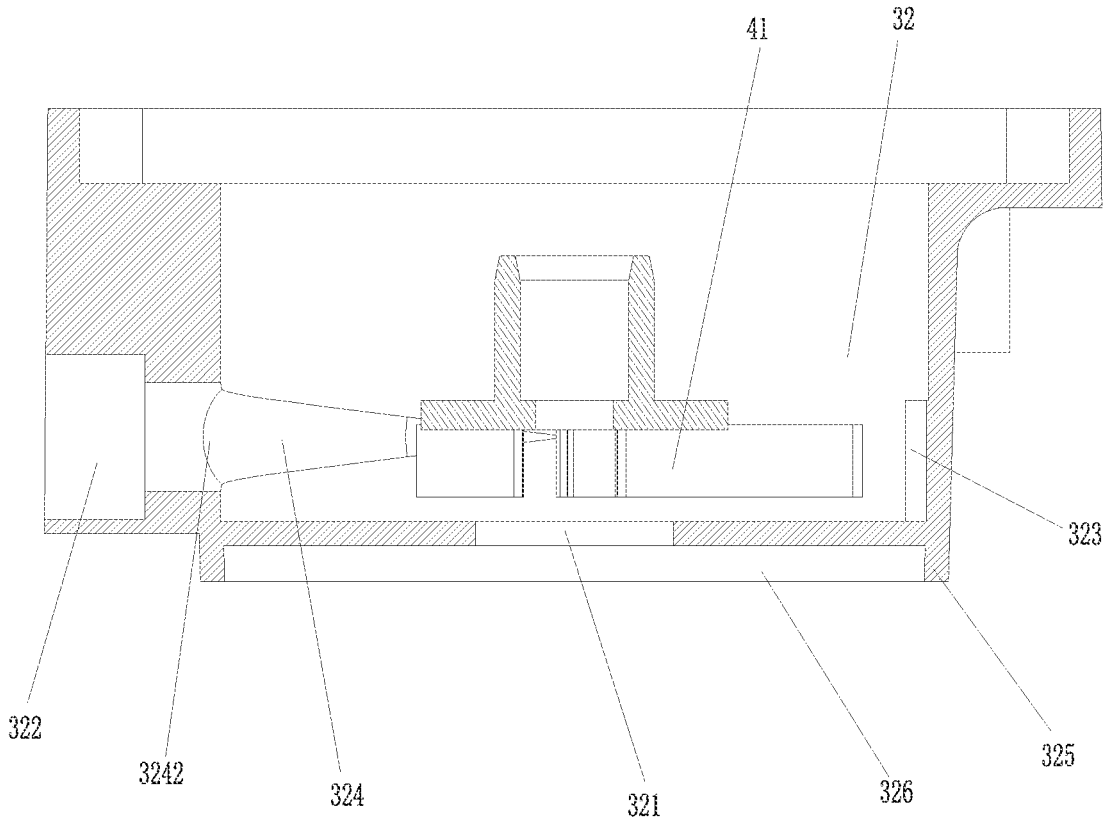
FIG. 8 is a cross-sectional view of the liquid pump according to the second embodiment of the present invention.

As shown in FIG. 7 and FIG. 8, a liquid-cooling pump comprises a liquid pump mounting chamber 32 and an impeller 41 mounted in the liquid pump mounting chamber 32. When the impeller 41 rotates, the liquid is driven to flow along the protruding boss 323 and the guide groove 324 to the distal end 3242 of the guide groove 324 to enter the liquid outlet 322, and then the liquid is discharged from the liquid outlet 322. Preferably, an annular wall 325 is provided around the outer periphery of the liquid inlet 321 to form a pressurizing chamber 326.

The feature of the present invention is that the inner wall of the peripheral side of the liquid pump mounting chamber is convexly provided with a protruding boss corresponding to one side of the liquid outlet and surrounding the impeller, and is concavely provided with a guide groove corresponding to the other side of the liquid outlet and surrounding the impeller. The flow channel structure plays a good role of guiding water, has better smoothness, is conducive to the increase of flow rate, and is conducive to improving the working efficiency of the liquid pump. Besides, the starting end of the protruding boss is a concave arcuate surface. When the liquid flushes to the starting end of the protruding boss, the concave arcuate surface provides a partial stop function for the liquid to flow back to the liquid outlet, so as to ensure the liquid output of the liquid outlet.

What is claimed is:

1. A flow channel structure of a liquid-cooling pump, comprising a liquid pump mounting chamber, a bottom of the liquid pump mounting chamber being centrally formed with a liquid inlet, a peripheral side of the liquid pump mounting chamber being formed with a liquid outlet; an inner wall of the peripheral side of the liquid pump mounting chamber being convexly provided with a protruding boss corresponding to one side of the liquid outlet and surrounding an impeller and being concavely provided with a guide groove corresponding to another side of the liquid outlet and surrounding the impeller; the protruding boss being gradually thinned along a rotating direction of the impeller, the guide groove being gradually deepened along the rotating direction of the impeller, a distal end of the guide groove communicating with the liquid outlet.

2. The flow channel structure of the liquid-cooling pump as claimed in claim 1, wherein a starting end of the protruding boss is a concave arcuate surface, when a liquid flushes to the starting end of the protruding boss, the concave arcuate surface provides a partial stop function for the liquid to flow back to the liquid outlet.

3. The flow channel structure of the liquid-cooling pump as claimed in claim 1, wherein the guide groove is gradually widened along the rotating direction of the impeller.

4. The flow channel structure of the liquid-cooling pump as claimed in claim 1, wherein the guide groove has an arc-shaped, V-shaped or rectangular cross-section.

5. The flow channel structure of the liquid-cooling pump as claimed in claim 1, wherein an annular wall is provided around an outer periphery of the liquid inlet to form a pressurizing chamber.

6. The flow channel structure of the liquid-cooling pump as claimed in claim 1, wherein a starting end of the guide groove is spaced a determined distance apart from a distal end of the protruding boss.

7. The flow channel structure of the liquid-cooling pump as claimed in claim 1, wherein the protruding boss and the guide groove are perpendicular to the inner wall of the peripheral side of the liquid pump mounting chamber.

8. A liquid-cooling pump, comprising the liquid pump mounting chamber as claimed in claim 1 and an impeller mounted in the liquid pump mounting chamber; wherein when the impeller rotates, a liquid is driven to flow along the protruding boss and the guide groove to the distal end of the guide groove to enter the liquid outlet, and the liquid is discharged from the liquid outlet.

* * * * *